US005787955A

United States Patent [19]

Dargie

[11] Patent Number: 5,787,955

[45] Date of Patent: Aug. 4, 1998

[54] SECURE TAMPER RESISTANT SAFETY NET SUPPORT SYSTEM AND ASSEMBLY

[76] Inventor: Roger A. Dargie, 105 Taywood Rd., Auburn, Me. 04210

[21] Appl. No.: 788,769

[22] Filed: Jan. 24, 1997

[51] Int. Cl.[6] ..... E04G 21/32

[52] U.S. Cl. ..... 160/368.1; 182/138

[58] Field of Search ..... 160/354, 332, 160/327, 368.1; 404/4, 54; 52/169.6, 169.7; 182/137, 138, 139; 4/487, 498, 500, 502

[56] References Cited

U.S. PATENT DOCUMENTS

| | | | |
|---|---|---|---|
| 1,993,285 | 5/1935 | Samuel | 187/51 |
| 2,085,559 | 6/1937 | Weber | 4/149 |
| 2,136,042 | 11/1938 | Cornell et al. | 39/85 |
| 2,313,496 | 3/1943 | Adams | 160/330 |
| 2,754,899 | 7/1956 | Karobonik et al. | 160/37 |
| 2,840,158 | 6/1958 | Lee | 160/327 |
| 2,958,872 | 11/1960 | Meyer, Jr. | 4/172 |
| 3,128,478 | 4/1964 | Beal | 4/172 |
| 3,344,440 | 10/1967 | Langer | 4/172 |
| 3,527,319 | 9/1970 | Pedley | 182/139 |
| 4,248,546 | 2/1981 | Danner | 404/25 |
| 4,960,150 | 10/1990 | Ryan | 137/234 |
| 4,966,217 | 10/1990 | Dechambeau et al. | 160/35 |
| 4,986,389 | 1/1991 | Haligan, Sr. et al. | 182/138 |
| 5,351,739 | 10/1994 | Levy | 160/124 |

FOREIGN PATENT DOCUMENTS 2701138 7/1978 Germany .

*Primary Examiner*—David M. Purol
*Attorney, Agent, or Firm*—Auslander & Thomas

[57] ABSTRACT

A secure and tamper resistant safety web assembly for a ground level hatch frame opening over a subterranean chamber horizontal affixable within hatch frame walls has pair of support brackets linked to a safety net that can be engaged so that it cannot be disengaged from the support brackets and is latchable closed to prevent the net from slipping if stressed. The structure is adaptable to be retrofit in most existing hatches. The stop end on the guide channel can include a link eye to receive a spring biased snap latch.

18 Claims, 8 Drawing Sheets

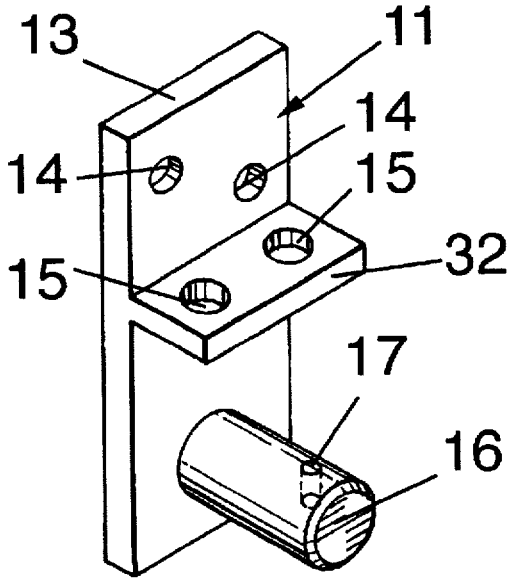
FIG. 1
FIG. 9
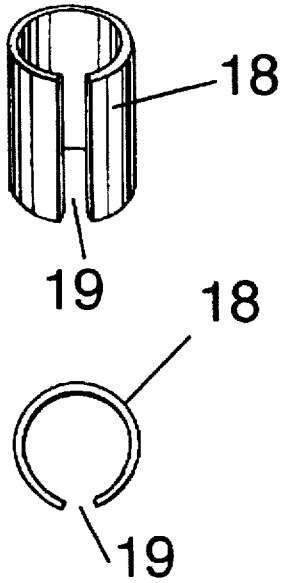
FIG. 10
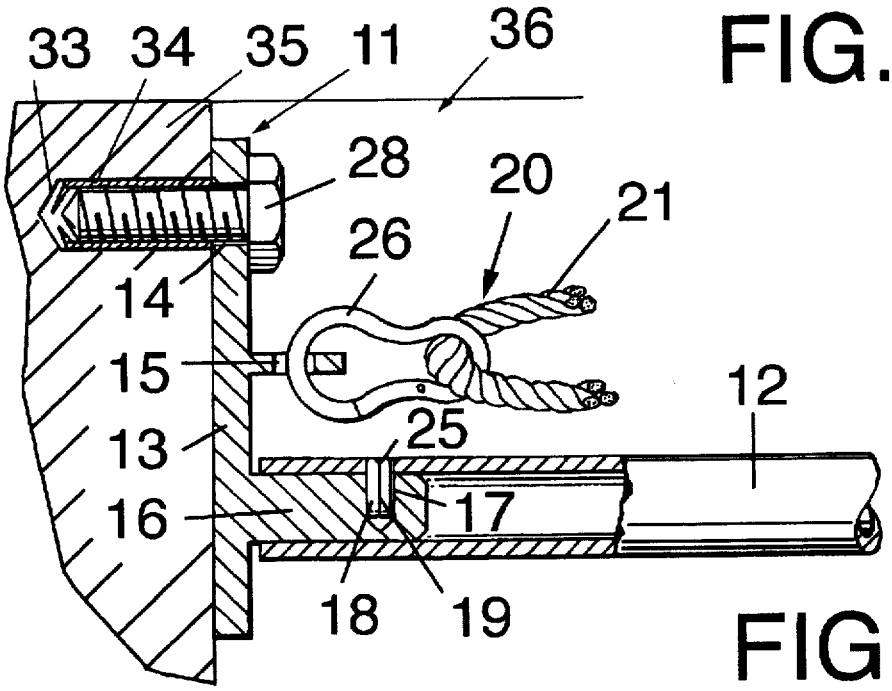
FIG. 2

FIG. 5
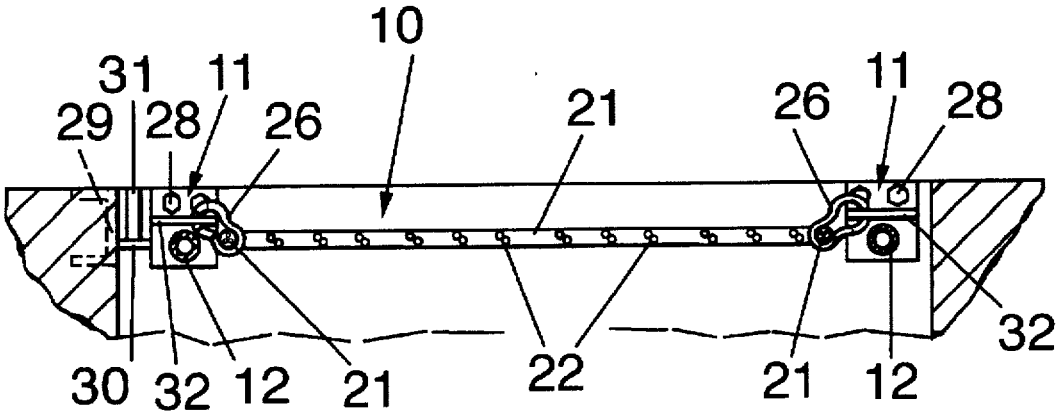
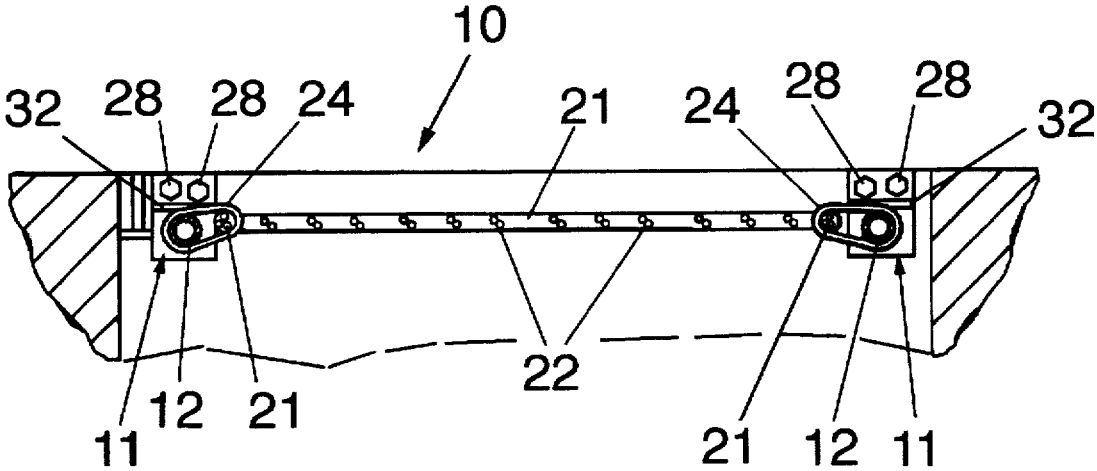
FIG. 4

FIG.6
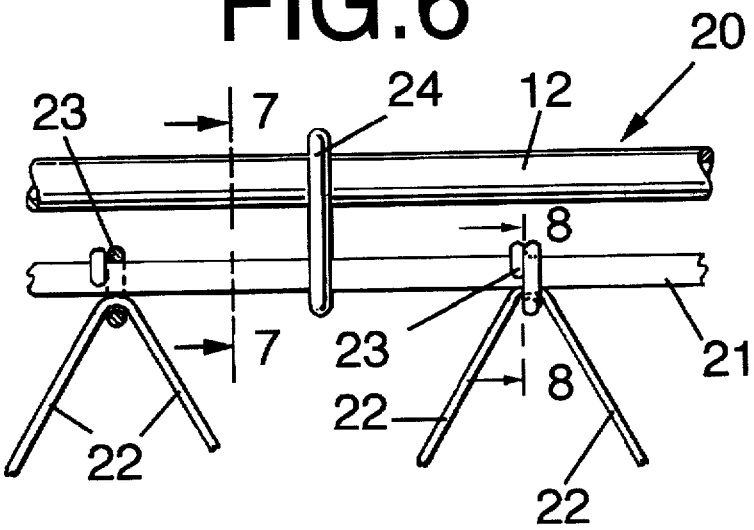
FIG. 7
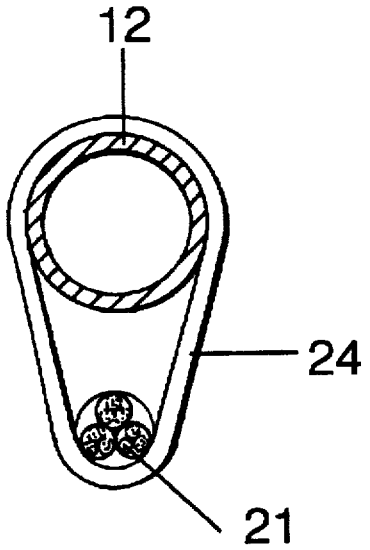
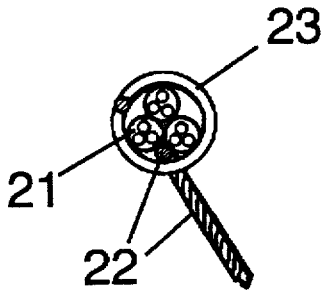
FIG. 8

FIG. 11
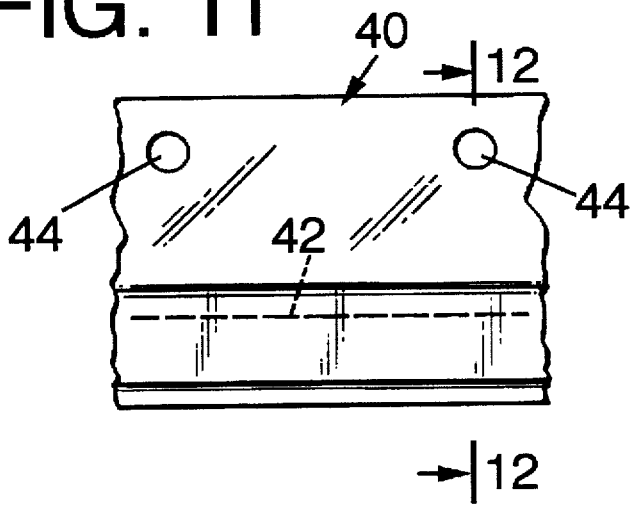
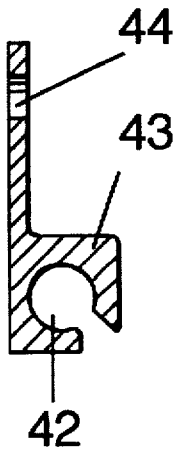
FIG. 12
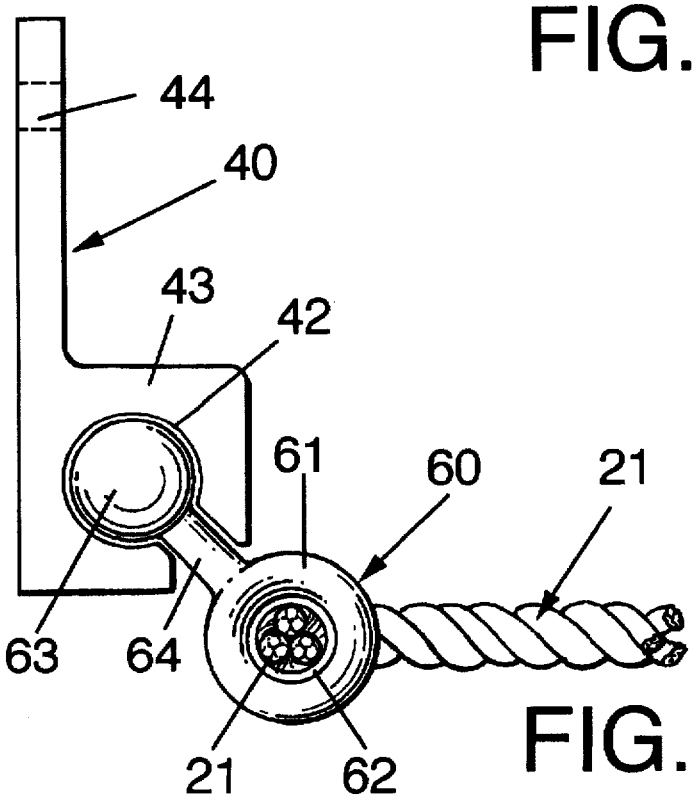
FIG. 13

FIG. 16
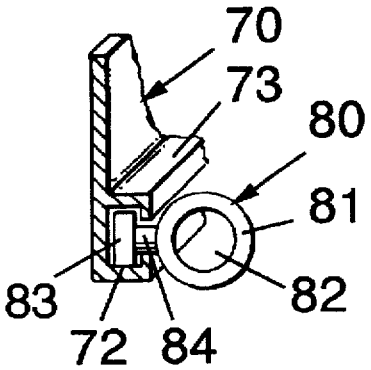
FIG.. 17
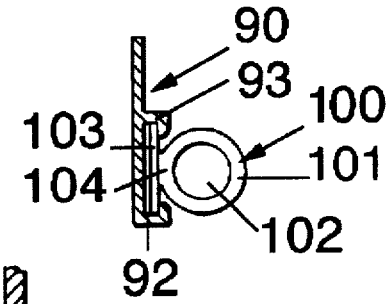
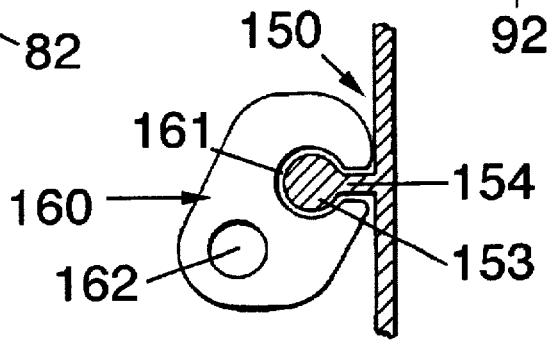
FIG. 20
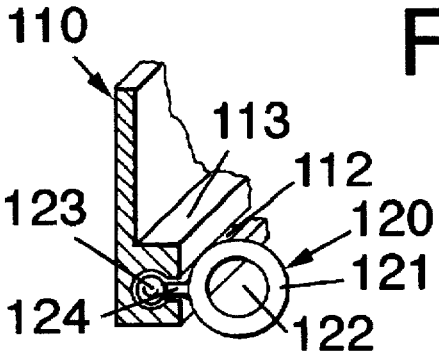
FIG. 18
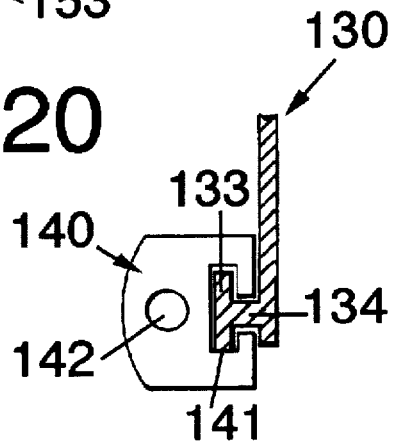
FIG. 19

SECURE TAMPER RESISTANT SAFETY NET SUPPORT SYSTEM AND ASSEMBLY

The present application is a continuation-in-part application of Provisional Application Ser. No. 60/011,062 filed Jan. 25, 1996.

BACKGROUND OF THE INVENTION

The present invention is an improvement of U.S. Pat. No. 5,265,974, dated Nov. 30, 1993, entitled Safety Net Assembly and System.

When gaining access to the inside of a subterranean chamber of a well, pumping station, or the like, once the hatch cover is opened, there is a great danger that someone, or something, may accidentally fall through the opening. Once the worker or workers have access to the space below, it is necessary to keep the hatch cover off or open to provide light and air in the area below. There was a need for some form of simple, inexpensive safety system to protect the public and the workers, when a hatch was open.

Oftentimes access to a subterranean chamber is usually necessary for a short period of time, such as for inspection or adjustment. It is important to have a safety system that is securely in place, or that could can easily be emplaced when access was required.

The present invention is a safety net support assembly and a safety net support system, an improvement of U.S. Pat. No. 5,265,974 for providing a secure tamper resistant safety net assembly to prevent falling into an open hatch over a subterranean chamber and protection for those within.

The hatch net system of U.S. Pat. No. 5,265,974 mounts within the frame of the hatch in the hatch opening, over an underground chamber. The net system was fastened to the hatch frame by using mounting brackets to support guide rails. The brackets were set into place on the ledges of the troughs, used for drainage, or after notches were cut.

The guide rods of U.S. Pat. No. 5,265,974 were only installable longitudinally in a hatch. It was also necessary to avoid the hatch cover lift springs. Installation of the mounting brackets for the guide rods on the ledges formed by the drainage troughs diminished the hatch frame opening.

In many cases more expensive larger hatch frames had to be specified in order to accommodate a safety net. There was a need for a secure substantially tamper resistant safety net assembly installation. In many instances, increasing the hatch frame size could not even be effective, since a larger hatch frame would extend beyond the chamber opening, making it impossible to meet the needs of what had to be done in the chamber and to provide a secure tamper resistant safety net assembly environment.

Many subterranean chambers have vertical guide rails for installing and servicing internal pumps. Vertical internal guide rails usually end where the guide rods of the Pat. No. 5,265,974 invention are, near the hatch opening. Thus, the mounting brackets for the guide rods had to be mounted higher than customary to accommodate the guide rails in the chamber, or in some instances, no installation could be made at all. Adjustments increased the cost of retrofitting the safety net system.

The vertical guide rails for retrieving a pump within the chamber oftentimes were also interfered with by the guide rods not allowing enough space for the pump to be lifted into the hatch opening.

The removal of the safety net assembly, in order to make room for the pump, was further unsatisfactory in view of the need for a secure tamper resistant installation.

A determining factor as to where the safety net assembly could be located in an existing hatch opening was the relationship between the brackets within the hatch frame and the bottom of the hatch frame. Reinforcing ribs on the inside of the hatch covers oftentimes protruded and interfered with the brackets.

Some hatch covers were provided with lift spring systems which interfered with the brackets of the net system of U.S. Pat. No. 5,265,974. Adjustment to avoid of the spring systems added expense to installing a net system.

DESCRIPTION OF THE RELATED ART

There are various systems available for protecting surface openings, such as hatches or manholes, so that people, or even animals, are not likely to fall in through open hatches. Most of these systems are bulky, expensive and/or complex and generally require the provision of erectable equipment, in order to protect the opening hatch or manhole.

U.S. Pat. No. 2,958,872 discloses a safety net type covering to cover a swimming pool. The net is exemplary of safety devices involved with covering open areas, such as a swimming pool. The patent also discloses exemplary hooking means for attaching such netting. The hook attaches to an anchor on a plunger.

U.S. Pat. No. 3,344,440 discloses another pool cover and catching means for engaging the pool cover, which is in the form of a net.

U.S. Pat. No. 3,128,478 is exemplary of a buoyant safety net cover for swimming pools and also discloses a mode for connecting such safety net and circumferential hooks to engage the round pool edge construction.

U.S. Pat. No. 3,527,319 is exemplary of a safety net for building construction having a flexible ring configuration for connecting and expanding such safety net using a ring and string configuration to engage the safety net to extending rings, hooks or shackles.

U.S. Pat. No. 4,986,389 is another safety net for covering a pit including a rope and guide cable mounted in eye bolts for slidability.

U.S. Pat. No. 4,248,546 discloses a manhole ceiling held in place by an expandable bar.

U.S. Pat. No. 4,960,150 discloses a complex safety cover movable deck configuration including tracks and rollers.

U.S. Pat. No. 2,085,559 discloses a bath tub and curtain construction with the curtain suspended from a rod and slidable on rings.

U.S. Pat. No. 2,136,042 discloses a vertical expandable mesh enclosure with bolts slidable in a slot in a bracket.

U.S. Pat. No. 2,313,496 discloses a vertical fireplace screen with the screen slidably attached to a rod by rings.

U.S. Pat. No. 1,993,285 discloses a vertical elevator safety gate with an engaged curtain on a rod slidable on an angle iron by shoes.

U.S. Pat. No. 2,840,158 discloses a vertical chain enclosure for a truck. A chain webbing is slidably suspended from a rod mounted on brackets having a cylindrical boss to receive the rod.

U.S. Pat. No. 2,754,899 discloses a safety cover for a swimming pool where a net is supported on rods which move on rollers in and angle iron track.

U.S. Pat. No. 5,351,739 is a vertical suspended shower curtain with a safety net all of which is movably suspended in a channel with rollers.

German Offenlegungsschrift Number 27 01 138 discloses an adjustable safety net frame with snap hooks for the net to attach to.

SUMMARY OF THE INVENTION

The present invention is a secure tamper resistant safety net assembly, installable within a hatch opening over a subterranean chamber. The safety net assembly is installed below the hatch cover of a manhole type opening, safety structure, such as for a deep well pumping stations or catch basins.

The present invention includes an installable safety net support system and assembly, protecting a hatch opening, once a cover has been removed or opened. The safety net support system is tamper resistant and securely installed, to always provide safety over a hatch opening, yet allow easy access to the interior of the space below.

The safety net support system of the present invention is a secure, tamper resistant emplacement of a net which fits within a hatch opening and includes means to slidably engage the net against sliding open.

Although such novel feature or features believed to be characteristic of the invention are pointed out in the claims, the invention and the manner in which it may be carried out, may be further understood by reference to the description following and the accompany drawing.

BRIEF DESCRIPTION OF THE DRAWING

FIG. 1 is an isometric view of a guide rod bracket.

FIG. 2 is a broken away detail of a guide rod bracket in a hatch opening, engaged at a wall, with a net latched against sliding.

FIG. 4 is a section of FIG. 3 at lines 4—4.

FIG. 5 is a section of FIG. 3 at lines 5—5.

FIG. 6 is a cut away detail of FIG. 5 showing the net linked to a guide rod.

FIG. 7 is a section of FIG. 6 at lines 7—7.

FIG. 8 is a section of FIG. 6 at lines 8—8.

FIG. 9 is an isometric detail of a circular pin to lock the guide rod to the guide rod bracket as shown in FIG. 2.

FIG. 10 is a top plan view of FIG. 9.

FIG. 11 is a broken away detail front elevation of a bracket bar of another embodiment of the present invention.

FIG. 12 is a section of FIG. 11 at lines 12—12.

FIG. 13 is an end elevation of a bracket bar of FIG. 11 showing a slidably engaged net holder and a section of the engaged net.

FIG. 16 is a detail sectional isometric view of another bracket bar and net holder configuration of the present invention.

FIG. 17 is a detail sectional end view of another bracket bar and net holder configuration of the present invention.

FIG. 18 is a detail isometric view of another bracket bar and net holder configuration of the present invention.

FIG. 19 is a detail sectional end view of another bracket bar and net holder configuration of the present invention.

FIG. 20 is a detail sectional end view of another bracket bar and net holder configuration of the present invention.

Referring now to the figures in greater detail, where like reference numbers denote like parts in the various figures.

DESCRIPTION OF THE PREFERRED EMBODIMENTS

Figure 3:
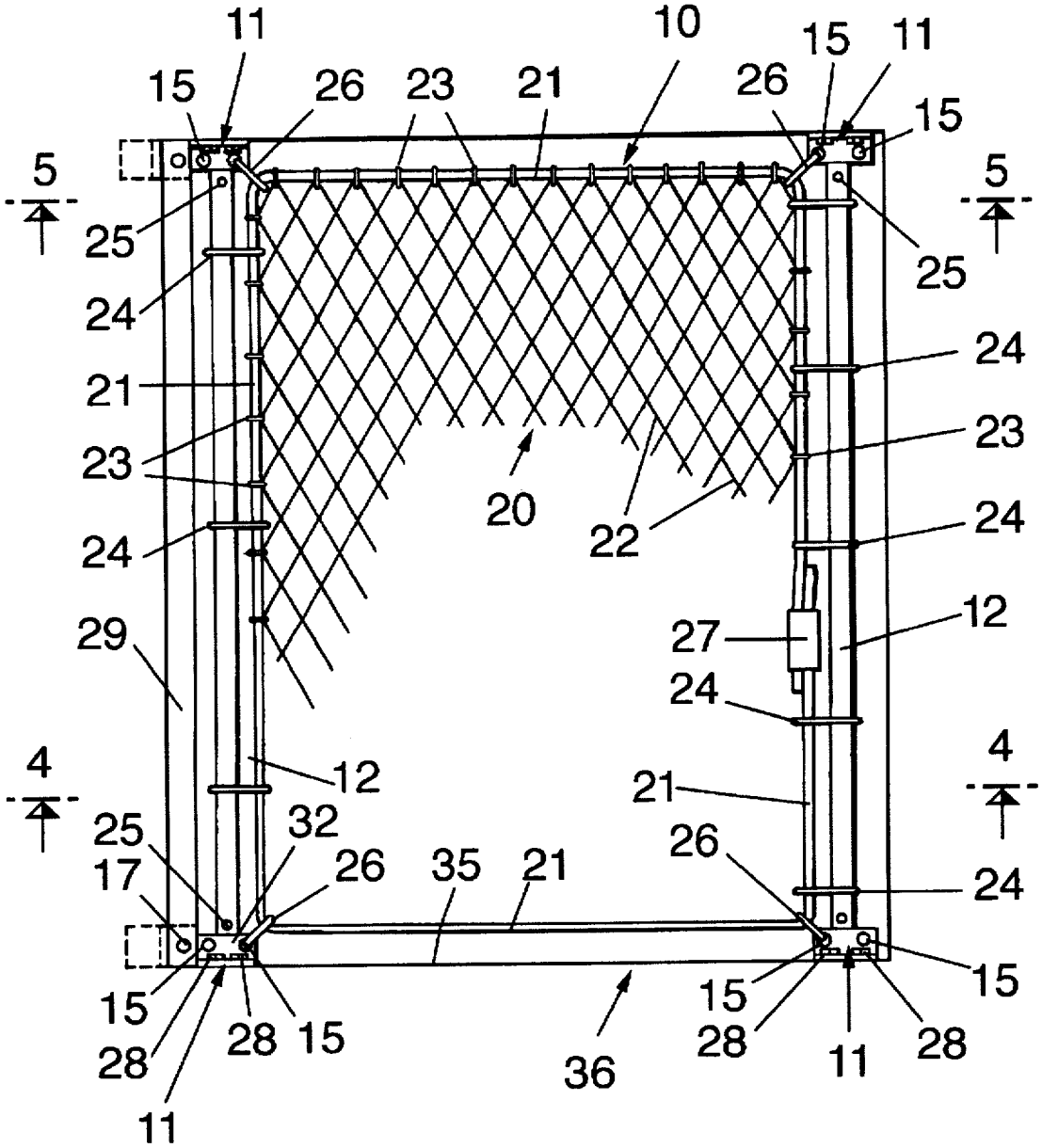
FIG. 3 is a top plan view of the hatch opening of FIG. 2, partially broken away, showing mounted guide rod brackets, with guide rods and a net held at the guide rod brackets.

The brackets and rods described herein are parts of sets of brackets and rods or bracket bars to slidably support the safety net support in the assembly of the present invention.

The safety net support assembly 10, as shown in FIGS. 1–10 and 21, comprises guide rod brackets 11 and guide rods 12. Particularly as shown in FIGS. 1–2, the guide rod bracket 11 includes, a body 13 with mount screw openings 14 and a latch bar 32. The latch bar 32 has link eyes 15 to receive a snap link 26 engaged on rope edging 21 on the safety net 20. The guide rod bracket 11 also includes a rod receiving boss 16 with a pin receiver 17.

As shown in FIG. 2, the guide rod bracket 11 is mounted on the concrete wall 35 of a hatch 36, with anchor screws 28 holding the guide rod bracket 11 in a hole 33 in the hatch wall, with a metal anchor 34. A guide rod 12 is engaged on the rod receiving boss 16 held by the circular pin 18, with a slit 19, passing through the rod pin opening 25 of the guide rod 12 engaged in the pin receiver 17.

As can be seen in FIGS. 3–5, the safety net support assembly 10 is engaged in the hatch 36. The guide rod brackets 11 is mounted on the concrete wall 35 with the guide rods 12 engaged, supporting the safety net 20.

Figure 21:
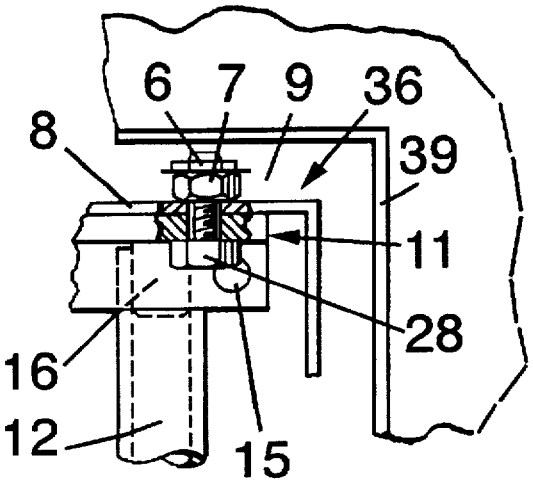
FIG. 21 is a broken away top plan view detail similar to the upper right hand corner of FIG. 3 with a bracket bar of FIGS. 1 and 2 anchored to a gutter wall with a lock nut.

As can be seen in FIG. 21, guide rod bracket 11 for the safety net support assembly 10 is engaged in hatch frame 39. The guide rod brackets 11 is mounted on the gutter wall 8 of the drain gutter 9 of the hatch 36. The anchor screw 28 is held by a lock nut 7 held by the integral nylon lock 6.

As can be seen in detail in FIG. 6, sliding links 24 are linked over the guide rods 12 and over the rope edging 21. The netting line 22 is securely bound to the rope edging 21 by line clamps 23. The netting line 22 is tied into a series of diamonds.

The rope edging 21 is securely held by the rope end clamp 27, as shown in FIG. 3. The safety net 20 is held in place, secure against sliding, by snap links 26 engaged in a link eye 15 in the latch bar, 32 as shown in FIGS. 2 and 3.

As shown in FIGS. 11–15, a bracket bar 40 has a slide channel 42 in a channel support 43. The bracket bar 40 includes mount screw openings 44.

FIG. 13 shows one net holder 60 slidably engaged in the slide channel 42 in the channel support 43 of the bracket bar 40. The net holder 60 has a net holding ring 61 with a ring opening 62 into which is engaged the safety net 20 rope edging 21. The shape of the sliding retainer 63 securely holds the net holder 60 in the slide channel 42. The net holding ring 61 and sliding retainer 63 are joined by the integral sliding retainer joint 64. Mount screw openings 44 are spaced along the length of the bracket bar 40.

Figure 14:
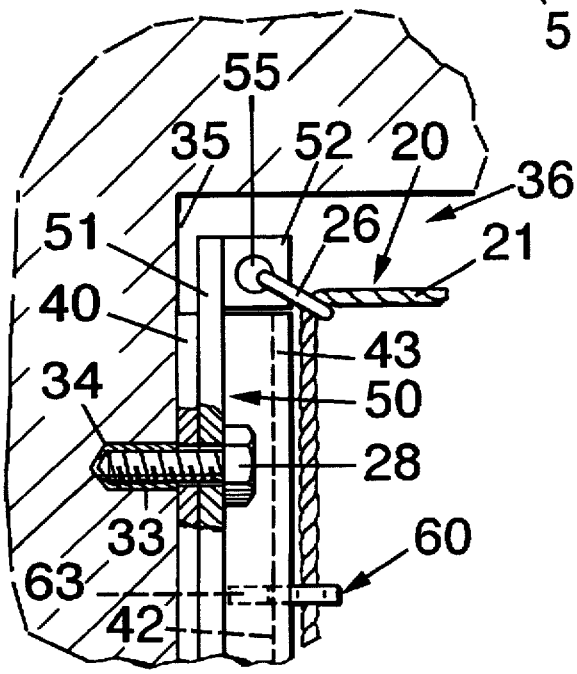
FIG. 14 is a broken away detail similar to FIG. 3 of a hatch opening with an anchored bracket bar of FIG. 11 locked closed by an end flange.

As shown in FIG. 14, a bracket bar 40 is mounted on the concrete wall 35 in a hatch 36. Anchor screws 28 (only one shown) hold the bracket bar 40 along the length one wall of the concrete wall 35 of the hatch 36. The anchor screws 28 are each set in a hole 33 in the concrete wall 35 held by metal anchors 34.

Figure 15:
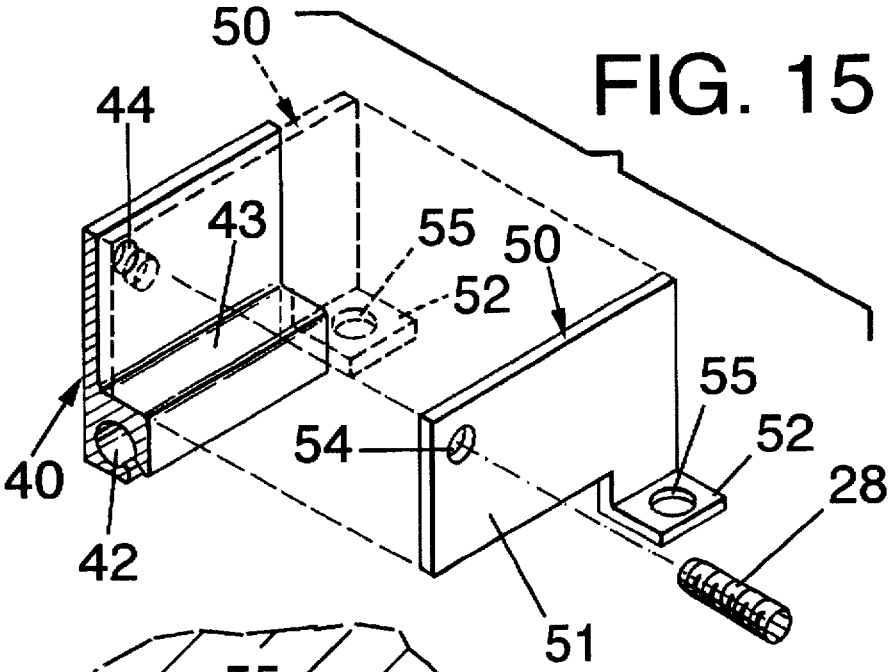
FIG. 15 is an exploded cut away isometric elevation detail of the end flange and bracket bar of FIG. 14.

An end flange 50 is mounted over the bracket bar 40, as shown in exploded detail in FIG. 15. The end flange 50 includes a planar portion 51, a channel lock 52, a link eye 55 and a mounting screw opening 54.

Another embodiment of the present invention includes the bracket bar 70 and net holder 80 as shown in FIG. 16. The bracket bar 70 includes a slide channel 72, mount screw openings (not shown) and a channel support 73. The net holder 80 includes a net holding ring 81, a ring opening 82, a sliding retainer 83 and an integral sliding retainer joint 84.

Another embodiment of the present invention includes the bracket bar 90 and net holder 100 as shown in FIG. 17. The bracket bar 90 includes a slide channel 92, mount screw openings (not shown) and a channel support 93. The net holder 100 includes a net holding ring 101, a ring opening 102, a sliding retainer 103 and an integral sliding retainer joint 104.

Another embodiment of the present invention includes the bracket bar 110 and net holder 120 as shown in FIG. 18. The bracket bar 110 includes a slide channel 112, mount screw openings (not shown) and a channel support 113. The net holder 120 includes a net holding ring 121, a ring opening 122, a sliding retainer 123 and an integral sliding retainer joint 124.

Another embodiment of the present invention includes the bracket bar 130 and net holder 140 as shown in FIG. 19. The bracket bar 130 includes a sliding retainer 133, mount screw openings (not shown) and an integral sliding retainer joint 134. The net holder 140 includes a net holder sliding guide 141, a rope edge 142.

Another embodiment of the present invention includes the bracket bar 150 and net holder 160 as shown in FIG. 20. The bracket bar 150 includes a sliding retainer 153, mount screw openings (not shown) and an integral sliding retainer joint 154. The net holder 160 includes a net holder sliding guide 161, a rope edge opening 162.

Figure 22:
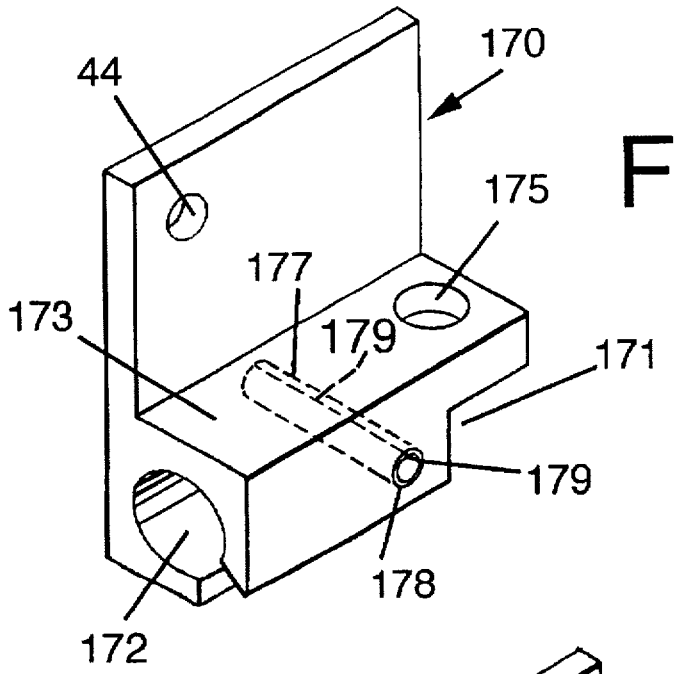
FIG. 22 is an isometric elevation detail of combination bracket bar and end flange similar to the bracket bar of FIG. 11.

Another embodiment of the present invention includes the combination bracket bar and end flange as shown in FIG. 22. The bracket bar 170 is similar to the bracket bar 40 of FIGS. 1–15. The bracket bar 170 includes mount screw openings 44 (only one shown), a slide channel 172, a cut out 171 and a link eye 175 at each end (only one shown) in the channel support 173. A pin receiver bore 177 is provided at each end of the bracket bar 170 (only one shown) which passes athwart the slide channel 172. A circular pin 178 with a slit 179 is engaged in the pin receiver bore 177. The link eye 175 is adjacent the cut out 171.

Figure 23:
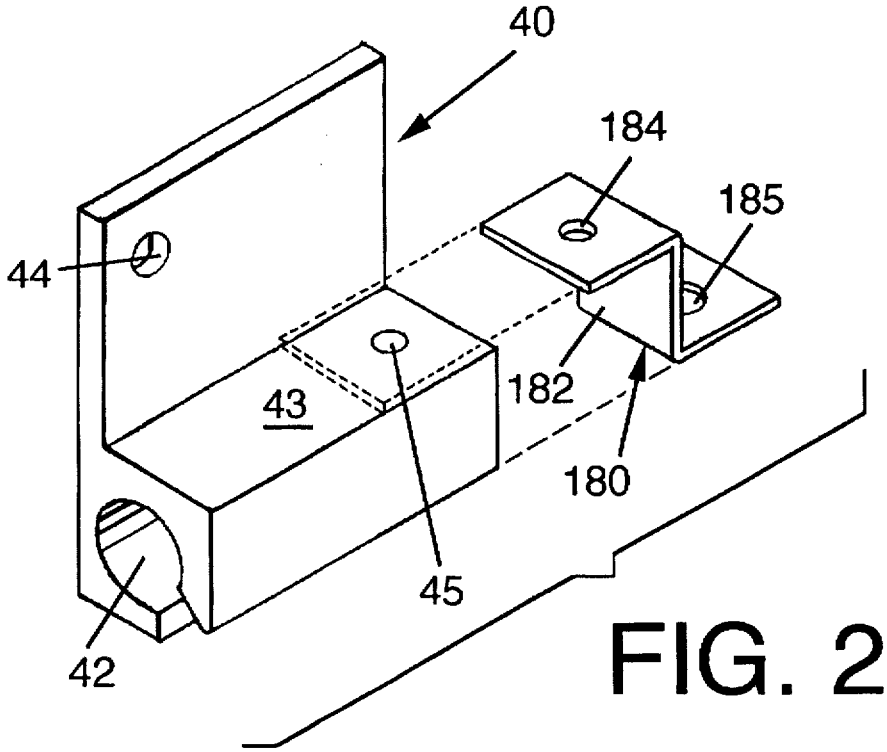
FIG. 23 is an exploded cut away isometric elevation detail of the end flange and bracket bar similar to FIG. 22 with a variant end flange.

Another embodiment of the present invention includes a bracket bar 40 and an end flange 180 as shown in FIG. 23. The bracket bar 40 includes screw opening 45 in the channel support 43 to receive an end flange 180. The end flange 180 includes a screw mounting opening 184, a channel lock 182 and a link eye 185.

The safety net support assembly 10 of the present invention as shown in FIGS. 1–10 is engaged in a hatch 36. The guide rod bracket 11 as shown in FIGS. 2–5 is anchored at the concrete wall 35 of a hatch 36.

As shown in FIG. 2, a guide rod 12 is engaged over the rod receiving boss 16 and held there by the circular pin 18, engaged in the pin receiver 17. The circular pin 18 passes through the rod pin opening 25, substantially without projecting, holding the guide rod 12 firmly on the rod receiving boss 16.

The circular pin 18 as shown in FIGS. 9 and 10 has a slit 19. The slit 19 allows the circular pin 18 which is of a strong resilient and somewhat malleable metal, to form. The circular pin 18 is of a length to fit into the pin receiver 17, and just extend beyond the opening of the rod pin opening 25. The pin receiver 17 has a slightly rounded bottom. A hammer blow on the engaged circular pin 18 forms it within the pin receiver 17 flush with the outer surface of the guide rod 12, expanded and formed into the rounded bottom of the pin receiver 17. The flush pin receiver 17 securely hold the guide rod bracket 11 and guide rod 12 in tamper resistant engagement.

The use of the metal anchors 34 with the anchor screws 28, as shown in FIG. 2, engages the guide rod bracket 11 in holes 33 in the concrete wall 35. The holes 33 are selectively drilled to properly place the guide rod brackets 11. The holes 33 with a metal anchor 34 engaged, securely hold the anchor screw 28 against the concrete wall 35 in tamper resistant engagement.

As shown in FIG. 3–8, the safety net 20 comprises a peripheral rope edging 21 and diamond knotted netting line 22. The netting line 22 is symmetrically spaced over the rope edging 21, held by line clamps 23 as shown in FIG. 6. The rope edging 21 is securely held together by a rope end clamp 27. The safety net 20 is slidably engaged on the guide rods 12 by symmetrically spaced sliding links 24 looped over the rope edging 21 and a guide rod 12. As can best be seen in FIGS. 2–5, snap links 26 at the corners of the safety net 20 are engagable with link eyes 15 in the guide rod bracket's 11 latch bar 32.

As shown in FIG. 3, two sets of guide rod brackets 11 are engaged in the hatch 36, supporting two guide rods 12, enabling the opening and closing of the safety net 20 over the opening in the hatch 36.

As shown in FIG. 21, the guide rod bracket 11 may be installed in the hatch frame 39 of a hatch 36 on the gutter wall 8 of a drain gutter 9. In this case, the secure and tamper resistant engagement of the anchor screw 28 is effected by the use of a lock nut 7 with a nylon lock 6. The safety net 20 is installed as shown in FIG. 3.

The bracket bars 40, 70, 90, 110, 130, 150 and 170 are installable either on a gutter wall 8 or concrete wall 35 for mounting a safety net 20. The length of the bracket bars are selected to match the opening in the hatch 36 formed by the concrete wall 35 or the gutter walls 8. Mount screw openings 44 are selectively spaced so that a secure and tamper resistant engagement can be effected.

The bracket bars 70, 90 and 110 and net holders 80, 100 and 120 are exemplary configurations of different mounts for the safety net 20.

The bracket bars 130 and 150 and net holders 140 and 160 are exemplary configurations of different mounts for the safety net 20. The net holder sliding guides 141 and 161 allow the engaged safety net 20 to interact and slide to open and close as shown in FIG. 3.

In order to provide a secure and tamper resistant safety net support assembly 10, the net holders 60, 80, 100, 120, 140 and 160 must be able to be securely loaded on, or in their respective bracket bars, 40, 70, 90, 110, 130 and 150.

As shown in FIGS. 14 and 15, an end flange 50 is engagable over bracket bars, 40, 70, 90, 110, 130 and 150 with a channel lock 52 forming a stop against the net holders 60, 80, 100, 120, 140 and 160 disengagement at the ends of the bracket bars 40, 70, 90, 110, 130 and 150.

As shown in FIG. 14, the rope edging 21 is engaged in the ring opening 62 of the net holder 60. The sliding retainer 63 is slidably engaged in the slide channel 42 of the bracket bar 40. The channel lock 52 blocks off the end of the slide channel 42 so that the safety net 20 cannot be disengaged. The link eye 55 receives the snap link 26 to secure the safety net 20 as shown in FIG. 3.

The bracket bar 170 has the convenience of providing a link eye 175 in the channel support 173 as a one piece unit. The stop function to keep the net holder 60 in the slide channel 172 is provided by the circular pin 178 in pin receiver bore 177 which blocks the slide channel 172.

The circular pin 178 has a slit 179. The slit 179 allows the circular pin 178 which is of a strong resilient and somewhat malleable metal, to form. The circular pin 178 is of a length to fit into the pin receiver bore 177 and just extend beyond the outer surface of the channel support 173. The pin receiver bore 177 is in two parts across the slide channel 172 and completes itself on the other side of the slide channel 172 (not shown) . A hammer blow on the circular pin 178 engaged in the pin receiver bore 177, forms it within the pin receiver bore 177 flush with the outer surface of the channel support 173, expanded and locked across the slide channel 172 in the pin receiver bore 177. The flush pin receiver 178 securely holds the net holders 60 secure and in tamper resistant engagement.

As shown in FIGS. 14 and 15, an end flange 50 is engagable over bracket bars, 40, 70, 90, 110, 130 and 150 with a channel lock 52 forming a stop against the net holders 60, 80, 100, 120, 140 and 160 disengagement at the ends of the bracket bars 40, 70, 90, 110, 130 and 150.

As shown in FIG. 23, an end flange 180 is engagable over bracket bars, 40, 70, 90, and 110 with a channel lock 182 forming a stop against the net holders 60, 80, 100, and 120 disengagement at the ends of the bracket bars 40, 70, 90, and 110.

The end flange 180 is easily fixed on the channel support 43 by screw means (not shown). The screw means (not shown) also may serve as a channel locking means with the channel lock 182 to prevent the disengagement of the net holders 60, 80, 100, and 120 disengagement at the ends of the bracket bars 40, 70, 90, and 110. The link eye 185 serves its normal function of receiving a snap link 26.

The end flange 180 of the present invention has the advantage of saving the cost of the additional length of bracket bar of solid metal and material and labor cost of having to provide a pin receiving bore 178, a circular split pin 178 and the labor of installing the circular pin 178.

IN USE

The safety net 20 must be securely and tamper resistantly engaged so that an open hatch 36 protects those inside a chamber below and others. A secure safety net 20 must be provided to resist tearing. The safety net 20 must be large enough to cover the opening of a hatch 36 be flexible to be able to open and close and be able to securely at least be held closed over the hatch 36.

The security of the safety net 20 is maintained by use of the snap links 26 placed at the corners of the safety net 20 engaging the rope edging 21 and being engagable in the link eyes 15. Thus, with the snap links 26 engaged in the link eyes 15, the safety net 20, as shown in FIG. 3, is securely held closed covering the open hatch 36. Access is obtained by releasing two snap links 26 so that the safety net 20 can be slid back along the guide rods 12 guided by the sliding links 24. Then security is reestablished by the reconnection of the snap links 26.

In all of the embodiments of the present invention, there is the same relationship between the link eyes 15, 55 175 and 185 with the snap links 26; they enable the safety net 20 to be to be securely opened and closed covering the open hatch 36.

The bracket bars 40, 70,90, 110, 130, 150 or 170 and net holders 60, 80, 100, 120, 140 and 160 interact as further embodiments of the present invention to enable the opening and closing of the safety net 20 over the opening in the hatch 36. They enable the placement of the safety net 20 in a hatch 36, or on a hatch frame 29, or on the gutter wall 8 of the hatch frame 39, or on a concrete wall 35 just as the guide rod brackets 11 and guide rods 12 do, securely and in a tamper resistant manner.

The ring openings 62, 82, 102, 122, and rope edge opening 142 and 162 hold the rope edging 21 in their respective net holding rings 61, 81, 101, 121, or net holder sliding guides 141, 161 so that the safety net 20 may be opened and closed. The sliding retainers 63, 83, 103, 123 and sliding retainers 133 and 153 are securely held in a tamper resistant manner as, set forth herein, engaged in their respective slide channels 42,72, 92, 112, 172 or sliding retainers 133 and 153, in the bracket bars 40, 70,90, 110, 130, 150 or 170.

It is preferable that the safety net 20 is prefabricated with the sliding links 24. Thus, the sliding links 24 can be loaded on to the guide rods 12 and be secure against coming off the guide rods 12 once the guide rod brackets 11 have been mounted.

It is preferable that the safety net 20 is prefabricated with the net holding rings 61, 81, 101, 121, or net holder sliding guides 141, 161, so they can be loaded into their respective slide channels 42, 72, 92, 112, 172 or sliding retainers 133 and 153, then securely and tamper resistantly secured at their ends.

The channel lock 52 of the end flange 50 secures ends of the slide channels 42, 72, 92, 112, or the ends of the sliding retainers 133 or 153. This can best be seen in FIG. 14. The circular pin 178 secures the ends of the slide channel 172 of the bracket bar 170 as shown in FIG. 22. All the embodiments of the present invention enable a safety net support assembly 10, and an assembly of bracket bars 40, 70, 90, 110, 130, 150 or 170 and net holders 60, 80, 100, 120, 140 and 160 enable the opening and the safety net 20 to be engaged in a hatch 36 or hatch frames 29, 39 with great ease security and flexibility, so that vertical guide rails within the subterranean chamber are not interfered with.

A screw (not shown) fixing the end flange 180 to the channel support 43 is engagable in the slide channel 42. The screw (not shown) or the screw with a nut, secures the ends of the slide channel 42 of the bracket bar 40. The screw (not shown) acts as an effective stop where it is fixed inside the channel 42.

The screw (not shown) also will hold the end flange 180 in place with the channel lock 182 closing the end of the channel 42, with the channel lock 182 at the opening of the channel 42. See FIG. 23. Once the end flange 180 is fixed at the screw opening 45, the link eye 185 is held in position to receive the a snap link 26 and hold the safety net 20 in place.

All the embodiments of the present invention enable a safety net support assembly 10, and an assembly of bracket bars 40, 70, 90, 110, 130, 150 or 170 and net holders 60, 80, 100, 120, 140 and 160 enable the opening and the safety net 20 to be engaged in a hatch 36 or hatch frames 29, 39 with great ease security and flexibility, so that vertical guide rails within the subterranean chamber are not interfered with.

The embodiments of the present invention are selectably installable where hatch covers have counterbalancing springs (not shown) or reinforcing inner ribs, with a minimum of adjustment.

The construction of the safety net support system of the present invention provides effective economy in terms of the cost of manufacture of the parts, as well as the labor saving cost in the installation of the system and assembly. The embodiments of the present invention are easily adjustable to many variations of hatch covers both as to the style of the hatch cover and the construction.

As shown in FIG. 5, the hatch cover 31 easily fits over the safety net support assembly 10 and the hatch cover 31 rests on the hatch cover ledge 30 of the hatch frame 29 without any interference.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

I claim:

1. A secure and tamper resistant safety web assembly for a ground level hatch frame opening over a subterranean chamber horizontal affixable within hatch frame walls, said hatch frame opening including at least two opposed substantially vertical wall portions, said safety web assembly affixable at said opposed substantially vertical wall portions, said safety web assembly including a web and means to support said web, said web having an open work structure; including a first end and a second end; a first side and a second side; a strong continuous edge along it periphery; and a span substantially the length and the width of said hatch frame opening, said means to support said web having a first part and a second part, each part having a length to engage within said one of said vertical wall portions, each said part affixable at one of said opposed substantially vertical wall portions, each part including means to guide one said web side to slide within one said length of one of said first or second parts, link means, said link means extending from said respective web sides and linking said peripheral edge of said web to said means to guide said web to slide, each side and end of said web forming a corner, releasable latching means extending from each said corner, said releasable latching means when all engaged securing said web from uncovering said hatch frame opening, stop means at said first and second parts to secure said linked web sides web from disengagement from said means to guide, and link eyes to receive said releasable latch means to fix said web securely in place.

2. The invention of claim 1 wherein said means to support said web having a first part and a second part includes two sets of rods with a mounting brackets at each end.

3. The invention of claim 2 wherein said means to guide one said web side to slide within one said length of one of said first or second parts is a rod.

4. The invention of claim 3 wherein said link means extending from said respective web sides and linking said peripheral edge of said web to said means to guide said web to slide is a metal loop engaged over said strong continuous edge along the periphery of said web and engaged over one of said rods.

5. The invention of claim 1 wherein said releasable latching means is a spring biased snap latch.

6. The invention of claim 1 wherein said means to support said web having a first part and a second part includes two bracket bars.

7. The invention of claim 6 wherein said bracket bar includes a channel support.

8. The invention of claim 7 wherein said channel support includes a slide channel.

9. The invention of claim 8 wherein said slide channel includes a channel opening along its length, said channel opening smaller than the diameter of said slide channel.

10. The invention of claim 9 wherein said channels includes stop means at their ends.

11. The invention of claim 10 wherein said channel include link eyes at their ends.

12. The invention of claim 10 wherein said stop means are separately affixable to said channel support and include both channel stop means and link eyes.

13. The invention of claim 6 wherein said bracket bar includes a sliding retainer.

14. The invention of claim 13 wherein said sliding retainer is integral with a linking sliding retainer joint.

15. The invention of claim 14 wherein including linking slidable retainer engaging said strong continuous edge of said web slidable along said sliding retainer.

16. The invention of claim 15 wherein said sliding retainers includes stop means at their ends.

17. The invention of claim 16 wherein said bracket bars include link eyes at their ends.

18. The invention of claim 17 wherein said stop means are separately affixable to said bracket bar include link eyes.

* * * * *

UNITED STATES PATENT AND TRADEMARK OFFICE

CERTIFICATE OF CORRECTION

PATENT NO. : 5,787,955

DATED : August 4, 1998

INVENTOR(S) : Roger A. Dargie

It is certified that error appears in the above-identified patent and that said Letters Patent is hereby corrected as shown below:

Column 4, line 36, change "brackets" to -- bracket -- line 40, after "rod", change "brackets" to -- bracket --

Column 8, line 37, delete "This can best be seen in FIG. 14."

Signed and Sealed this

Sixth Day of October, 1998

Bruce Lehman

*Attest:*

BRUCE LEHMAN

*Attesting Officer*

*Commissioner of Patents and Trademarks*